US006923735B1

(12) United States Patent
Hayashi

(10) Patent No.: US 6,923,735 B1
(45) Date of Patent: Aug. 2, 2005

(54) GOLF BALL

(75) Inventor: Junji Hayashi, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 25 days.

(21) Appl. No.: 10/771,234

(22) Filed: Feb. 4, 2004

(51) Int. Cl.[7] ..... A63B 37/06
(52) U.S. Cl. ..... 473/376
(58) Field of Search ..... 473/376, 377, 473/373, 374, 351

(56) References Cited

U.S. PATENT DOCUMENTS

| | | | | |
|---|---|---|---|---|
| 5,306,760 | A | 4/1994 | Sullivan | |
| 5,312,857 | A | 5/1994 | Sullivan | |
| 5,733,205 | A | 3/1998 | Higuchi et al. | |
| 6,135,898 | A | 10/2000 | Higuchi et al. | |
| 6,251,031 | B1 | 6/2001 | Hayashi et al. | |
| 6,565,456 | B2 | 5/2003 | Hayashi et al. | |
| 2002/0137848 | A1 | 9/2002 | Sone et al. | |
| 2003/0207970 | A1 * | 11/2003 | Higuchi et al. | 524/263 |
| 2003/0207999 | A1 * | 11/2003 | Higuchi et al. | 525/274 |
| 2004/0019149 | A1 * | 1/2004 | Higuchi et al. | 524/571 |

FOREIGN PATENT DOCUMENTS

| | | | |
|---|---|---|---|
| JP | 7-268132 | A | 10/1995 |
| JP | 8-336618 | A | 12/1996 |
| JP | 11-35633 | A | 2/1999 |
| JP | 11-164912 | A | 6/1999 |
| JP | 11-253579 | A | 9/1999 |
| JP | 2000-060997 | A | 2/2000 |
| JP | 2000-061002 | A | 2/2000 |
| JP | 2001-218872 | A | 8/2001 |
| JP | 2002-293996 | A | 10/2002 |
| WO | WO 98/46671 | A1 | 10/1998 |

OTHER PUBLICATIONS

C. Jeff Harlan et al.; "Three–Coordinate Aluminum Is Not A Prerequisite for Catalytic Activity In The Zirconocene–Alumoxane Polymerization Of Ethylene"; American Chemical Society; 117; 1995; pp. 6465–6474.

Mark R. Mason et al.; "Hydrolysis of Tri–*tert*–butylaluminum: The First Structural Characterization of Alkylalumoxanes $[(R_2A1)_2O]_a$ and $(RA1O)_n$"; American Chemical Society; 115; 1993; pp. 4971–4984.

"Reaction Mechanisms in Metallocene Catalyzed Olefin Polymerization"; Report of Research & Development, Fine Chemical, vol. 23, No. 9; 1994; pp. 5–15.

* cited by examiner

*Primary Examiner*—Raeann Gorden
(74) *Attorney, Agent, or Firm*—Sughrue Mion, PLLC

(57) ABSTRACT

A golf ball having a core, an envelope layer enclosing the core, an intermediate layer enclosing the envelope layer and a cover enclosing the intermediate layer is characterized in that the core is made from a specific rubber composition which has been molded and vulcanized, the envelope layer is made from a thermoplastic resin, the intermediate layer is made from a thermoplastic resin containing at least 30 wt % of an ionomer resin, and the cover is made from a thermoplastic resin containing at least 50 wt % of an ionomer resin. The golf ball is also characterized in that the following have been optimized: the rebound resilience of the thermoplastic resin from which the envelope layer is made, the thickness of the envelope layer, the Shore D hardness of the envelope layer, the thickness of the intermediate layer, the Shore D hardness of the intermediate layer, the thickness of the cover, the Shore D hardness of the cover, the combined thickness of the envelope layer, intermediate layer and cover, and the Shore D hardness distribution among the center of the core, the surface of the core, the envelope layer, the intermediate layer and the cover.

8 Claims, 1 Drawing Sheet

GOLF BALL

BACKGROUND OF THE INVENTION

The present invention relates to a golf ball which has a high durability, yet also is endowed with a high rebound, a high launch angle, a low spin and a good feel upon impact.

Recently, as the golfing population has grown, the qualities that golfers desire in a golf ball have become more diverse and individualized. Various efforts have been made to develop balls with constructions that satisfy such desires. Compared with thread-wound golf balls, the many types of two-piece and other solid golf balls that have hitherto been disclosed provide a straight, flat trajectory, both on shots taken with a driver and shots taken with an iron. In addition, they have structural characteristics which make them less susceptible to spin, resulting in a good run that increases the total distance.

Yet, in addition to having a long distance, it is essential for a golf ball to also have a soft feel when hit. Thread-wound golf balls have structural characteristics which, compared with solid golf balls, generally make them very soft and provide them with a good feel. Softening of the ball construction so as to achieve a soft feel at the time of impact is generally carried out in two-piece solid golf balls as well. Softening of the ball construction also contributes to a lower spin and a higher launch angle, which can in turn lead to an increased distance.

However, it is exceedingly difficult to obtain golf balls having both the carry of a two-piece solid golf ball and the feel of a thread-wound golf ball, and so the desires of golfers have yet to be fully addressed. Although softening the ball's construction can help to reduce spin and increase the launch angle, such a ball undergoes excessive deformation, particularly when hit by high head speed golfers, which can lower the initial velocity of the ball.

Three-piece solid golf balls in which an intermediate layer is provided between the core and the cover, and multi-piece solid golf balls constructed of four or more layers have been developed with the aim of achieving in a single ball both the carry of a two-piece solid golf ball and the feel of a thread-wound golf ball (e.g., U.S. Pat. No. 6,135,898,: U.S. Pat. No. 5,733,205,: U.S. Pat. No. 6,251,031,; U.S. Pat. No. 6,565,456,).

However, even these golf balls leave considerable room for further improvement in their rebound, launch angle, spin reduction and feel on impact.

SUMMARY OF THE INVENTION

In light of the above circumstances, the object of the invention is to provide a golf ball which has a high durability yet is endowed with a high rebound, a high launch angle, a low spin and a good feel upon impact.

The inventors have conducted extensive investigations in order to achieve the above object. As a result, they have discovered that, in a golf ball having a core, an envelope layer enclosing the core, an intermediate layer enclosing the envelope layer and a cover enclosing the intermediate layer, by having the core made from a specific butadiene rubber, having the intermediate layer and the cover each made from thermoplastic resins containing specific amounts of ionomer resins, and at the same time optimizing the rebound resilience of the envelope layer, the thickness of the envelope layer, the Shore D hardness of the envelope layer, the thickness of the intermediate layer, the Shore D hardness of the intermediate layer, the thickness of the cover, the Shore D hardness of the cover, the combined thickness of the envelope layer, intermediate layer and the cover, and the Shore D hardness distribution in the various layers, there can be obtained a golf ball which has a high durability yet also is endowed with a high rebound, a high launch angle, a low spin and a good feel upon impact.

Accordingly, the invention provides the following golf balls.

[I] A golf ball comprising a core, an envelope layer enclosing the core, an intermediate layer enclosing the envelope layer, and a cover enclosing the intermediate layer, which golf ball is characterized in that the core is obtained by molding and vulcanizing a rubber composition comprising 100 parts by weight of a base rubber which includes 60 to 100 wt % of a polybutadiene of at least 60% cis-1,4 structure, has a Mooney viscosity ($ML_{1+4}$ (100° C.)) of at least 40 and is synthesized using a rare earth catalyst, 10 to 60 parts by weight of an unsaturated carboxylic acid and/or an unsaturated carboxylic acid metal salt, 0.1 to 5 parts by weight of an organosulfur compound, 5 to 80 parts by weight of an inorganic filler and 0.1 to 0.8 part by weight overall of at least two different organic peroxides which have, letting the organic peroxide with the shortest half-life at 155° C. be (p), the organic peroxide with the longest half-life at 155° C. be (q), the half-life of (p) be Pt and the half-life of (q) be $q_t$, a half-life ratio $q_t/p_t$, of at least 7 but not more than 20, the envelope layer is made from a thermoplastic resin, the intermediate layer is made from a thermoplastic resin containing at least 30 wt % of an ionomer resin, and the cover is made from a thermoplastic resin containing at least 50 wt % of an ionomer resin; and in that the golf ball satisfies following conditions (1) to (9):

(1) the thermoplastic resin from which the envelope layer is made has a rebound resilience, as measured in accordance with British Standard 903 (BS 903), of at least 65, (2) the envelope layer has a thickness of at least 0.5 mm but less than 1.5 mm, (3) the envelope layer has a Shore D hardness of at least 5 but less than 30, (4) the intermediate layer has a thickness of at least 0.5 mm but less than 1.5 mm, (5) the intermediate layer has a Shore D hardness of at least 40 but less than 56, (6) the cover has a thickness of at least 0.5 mm but less than 1.5 mm, (7) the cover has a Shore D hardness of at least 56 and but not more than 70.

(8) the envelope layer, intermediate layer and cover have a combined thickness of at least 1.5 mm but less than 4.5 mm, and (9) when the Shore D hardness at the center of the core, the Shore D hardness at the surface of the core, the Shore D hardness of the envelope layer, the Shore D hardness of the intermediate layer and the Shore D hardness of the cover are compared, the envelope layer has the lowest Shore D hardness.

[II] The golf ball of [I] which additionally satisfies following condition (10):

(10) the core has a deflection when subjected to a load of 100 kg of at least 3.0 mm but not more than 6.0 mm.

[III] The golf ball of [I], wherein the thermoplastic resin making up the envelope layer is an ester thermoplastic elastomer.

[IV] The golf ball of [I] which additionally satisfies following conditions (11) and (12):

(11) 3≦(Shore D hardness of cover)−(Shore D hardness of intermediate layer)≦30, and

(12) 10≦(Shore D hardness of intermediate layer)−(Shore D hardness of envelope layer)≦45.

[V] The golf ball of [I] which additionally satisfies following condition (13):

(13) the intermediate layer and cover layer have melt flow rates of at least 1.6 dg/min.

[VI] The golf ball of [I], wherein the intermediate layer is composed of (a) 100 parts by weight of an olefin-unsaturated carboxylic acid random copolymer and/or an olefin-unsaturated carboxylic acid-unsaturated carboxylic acid ester random copolymer, (b) 5 to 80 parts by weight of a fatty acid having a molecular weight of at least 280 or a derivative thereof, and (c) 0.1 to 10 parts by weight of a basic inorganic metal compound capable of neutralizing acid groups on components (a) and (b).

[VII] The golf ball of [I], wherein the intermediate layer is composed of (d) 100 parts by weight of a metal ion neutralization product of an olefin-unsaturated carboxylic acid random copolymer and/or a metal ion neutralization product of an olefin-unsaturated carboxylic acid-unsaturated carboxylic acid ester random copolymer, (b) 5 to 80 parts by weight of a fatty acid having a molecular weight of at least 280 or a derivative thereof, and (c) 0.1 to 10 parts by weight of a basic inorganic metal compound capable of neutralizing acid groups on components (d) and (b).

[VIII] The golf ball of [I], wherein the intermediate layer is composed of 100 parts by weight of a mixture of (a) an olefin-unsaturated carboxylic acid random copolymer and/or an olefin-unsaturated carboxylic acid-unsaturated carboxylic acid ester random copolymer with (d) a metal ion neutralization product of an olefin-unsaturated carboxylic acid random copolymer and/or a metal ion neutralization product of an olefin-unsaturated carboxylic acid-unsaturated carboxylic acid ester random copolymer, (b) 5 to 80 parts by weight of a fatty acid having a molecular weight of at least 280 or a derivative thereof, and (c) 0.1 to 10 parts by weight of a basic inorganic metal compound capable of neutralizing acid groups on components (a), (d) and (b).

BRIEF DESCRIPTION OF THE FIGURE

The advantages, nature and various additional features of the invention will appear more fully upon consideration of the illustrative embodiment of the invention which is schematically set forth in the figure, in which.

DETAILED DESCRIPTION OF THE INVENTION

Figure 1:
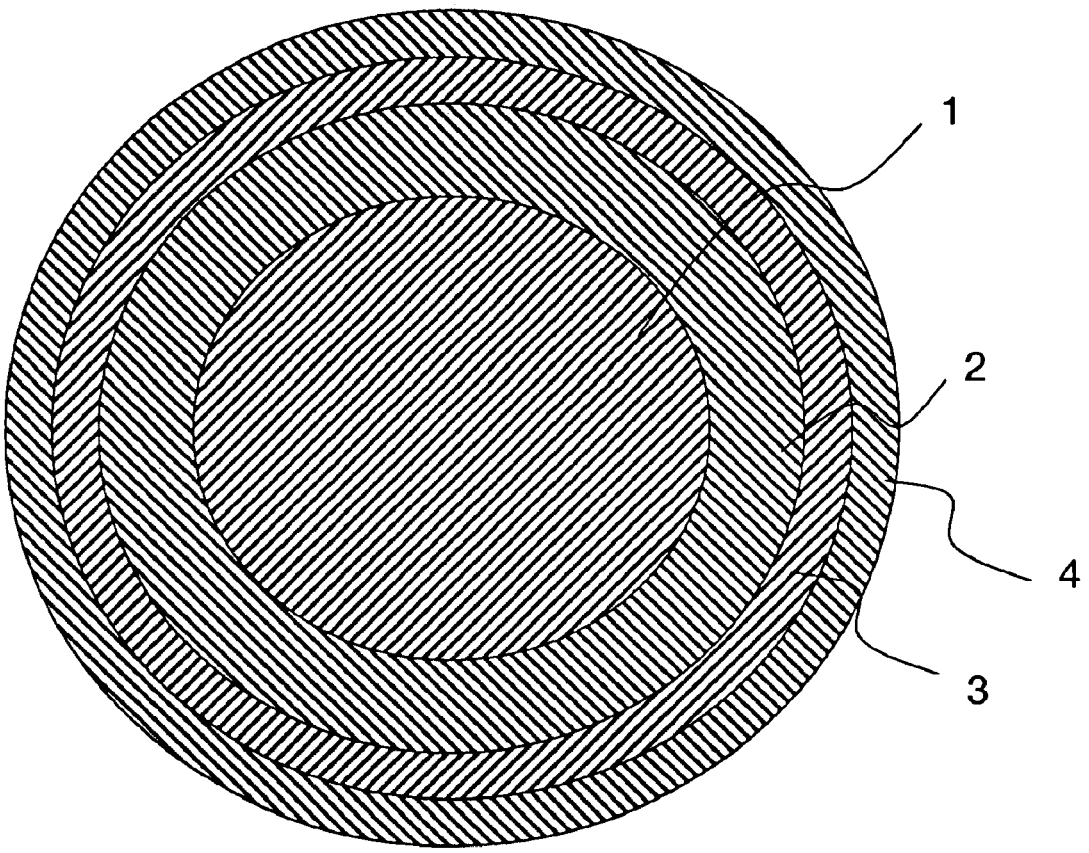
FIG. 1 is a diagrammatical representation of a golf ball according to the present invention.

The invention is described more fully below.

The golf ball of the invention is a golf ball having a core (1), an envelope layer (2) enclosing the core (1), an intermediate layer (3) enclosing the envelope layer (2) and a cover (4) enclosing the intermediate layer (3), wherein the core (1) is made from a specific butadiene rubber, the intermediate layer (3) and the cover (4) are each made from thermoplastic resins containing specific amounts of ionomer resins, and the following are optimized: the rebound resilience of the envelope layer (2), the thickness of the envelope layer (2), the Shore D hardness of the envelope layer (2), the thickness of the intermediate layer (3), the Shore D hardness of the intermediate layer (3), the thickness of the cover (4), the Shore D hardness of the cover (4), the combined thickness of the intermediate layer (3) and the cover (4), and the Shore D hardness distribution in the various layers.

To achieve a golf ball having a soft feel and a high launch angle, the core in the inventive golf ball is made of a core material obtained by molding and vulcanizing a rubber composition containing:

(A) a base rubber which includes 60 to 100 wt % of a polybutadiene of at least 60 to cis-1,4 structure, has a Mooney viscosity ($ML_{1+4}$ (100° C.)) of at least 40 and is synthesized using a rare earth catalyst;

(B) an unsaturated carboxylic acid and/or an unsaturated carboxylic acid metal salt;

(C) an organosulfur compound;

(D) an inorganic filler; and (E) an organic peroxide.

By having the core, which accounts for a large proportion of the golf ball volume, made from such a material, the golf ball can be designed so as to have a soft feel and a high rebound.

The polybutadiene in component A has a cis-1,4 unit content on the polymer chain of generally at least 60 wt %, preferably at least 80 wt %, more preferably at least 90 wt %, and even more preferably at least 95 wt %. A polybutadiene having too low a cis-1,4 unit content may lower the resilience.

Moreover, the polybutadiene has a 1,2-vinyl unit content on the polymer chain of generally not more than 2%, preferably not more than 1.7%, and even more preferably not more than 1.5%. Too high a 1,2-vinyl unit content may lower the resilience.

To obtain a rubber composition having excellent resilience, or to obtain a rubber composition having a good extrusion workability, the polybutadiene has a Mooney viscosity ($ML_{1+4}$ (100° C.)) of generally at least 40, preferably at least 50, more preferably at least 52, and even preferably at least 54, but generally not more than 140, preferably not more than 120, more preferably not more than 100, and even more preferably not more than 80.

The term "Mooney viscosity" used herein refers to an industrial index of viscosity (JIS K6300) as measured with a Mooney viscometer, which is a type of rotary plastometer. The unit symbol used here is $ML_{1+4}$ (100° C.), where "M" stands for Mooney viscosity, "L" stands for large rotor (L-type), and "1+4" stands for a pre-heating time of 1 minute and a rotor rotation time of 4 minutes. The "100° C." indicates that measurement was carried out at a temperature of 100° C.

To obtain a molded and vulcanized rubber composition of good resilience, the polybutadiene used in the invention is preferably synthesized with a rare-earth catalyst or a group VIII metal compound catalyst. Polybutadiene synthesized with a rare-earth catalyst is especially preferred.

Such rare-earth catalysts are not subject to any particular limitation. Exemplary rare-earth catalysts include those made up of a combination of a lanthanide series rare-earth compound with an organoaluminum compound, an alumoxane, a halogen-bearing compound and an optional Lewis base.

Examples of suitable lanthanide series rare-earth compounds include halides, carboxylates, alcoholates, thioalcoholates and amides of atomic number 57 to 71 metals.

Organoaluminum compounds that may be used include those of the formula $AlR^1R^2R^3$ (wherein $R^1$, $R^2$ and $R^3$ are each independently a hydrogen or a hydrocarbon group of 1 to 8 carbons).

Preferred alumoxanes include compounds of the structures shown in formulas (I) and (II) below. The alumoxane association complexes described in Fine Chemical 23, No. 9, 5 (1994), J. Am. Chem. Soc. 115, 4971 (1993), and J. Am. Chem. Soc. 117, 6465 (1995) are also acceptable.

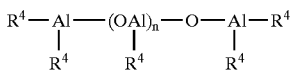

(I)

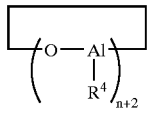

(II)

In the above formulas, $R^4$ is a hydrocarbon group having 1 to 20 carbon atoms, and n is 2 or a larger integer.

Examples of halogen-bearing compounds that may be used include aluminum halides of the formula $AlX_nR_{3-n}$, (wherein X is a halogen; R is a hydrocarbon group of 1 to 20 carbons, such as an alkyl, aryl or aralkyl; and n is 1, 1.5, 2 or 3); strontium halides such as $Me_3SrCl$, $Me_2SrCl_2$, $MeSrHCl_2$ and $MeSrCl_3$; and other metal halides such as silicon tetrachloride, tin tetrachloride and titanium tetrachloride.

The Lewis base may be any Lewis base that can be used to form a complex with the lanthanide series rare-earth compound. Illustrative examples include acetylacetone and ketone alcohols.

In the invention, the use of a neodymium catalyst in which a neodymium compound serves as the lanthanide series rare-earth compound is advantageous because it enables a polybutadiene rubber having a high cis-1,4 unit content and a low 1,2-vinyl unit content to be obtained at an excellent polymerization activity. Preferred examples of such rare-earth catalysts include those mentioned in JP-A 11-35633, JP-A 11-164912 and JP-A 2002-293996.

To achieve a polybutadiene having a cis unit content within the above range and a polydispersity index Mw/Mn within the subsequently described range, it is preferable for the polymerization of butadiene in the presence of a rare-earth catalyst containing a lanthanide series rare-earth compound to be carried out at a butadiene/(lanthanide series rare-earth compound) molar ratio of generally 1,000 to 2,000,000, and especially 5,000 to 1,000.000, and at an $AlR^1R^2R^3$/(lanthanide series rare-earth compound) molar ratio of generally 1 to 1,000, and especially 3 to 500. It is also preferable for the (halogen compound)/(lanthanide series rare-earth compound) molar ratio to be generally 0.1 to 30, and especially 0.2 to 15, and for the (Lewis base)/(lanthanide series rare-earth compound) molar ratio to be generally 0 to 30, and especially 1 to 10.

The polymerization of butadiene in the presence of a rare-earth catalyst may be carried out by bulk polymerization or vapor phase polymerization, either with or without the use of solvent, and at a polymerization temperature of generally −30 to 150° C., and preferably 10 to 100° C.

In the invention, the polybutadiene included in component A may instead be one obtained by polymerizing butadiene using the above-described rare-earth catalyst, then reacting a terminal modifier with active end groups on the polymer.

Such modified polybutadiene rubbers can be obtained by polymerization as described above, followed by the use of a terminal modifier selected from among types (i) to (vii) below.

(i) Compounds having an alkoxysiliy group to be reacted with the polymer at active ends thereof. Preferred alkoxysilyl group-bearing compounds are alkoxysilane compounds having at least one epoxy group or isocyanate group on the molecule. Specific examples include epoxy group-bearing alkoxysilanes such as 3-glycidyloxypropyltrimethoxysilane. 3-glycidyloxypropyltriethoxysilane, (3-glycidyloxypropyl)methyldimethoxysilane, (3-glycidyloxypropyl)methyldiethoxysilane, β-(3,4-epoxycyclohexyl)trimethoxysilane, β-(3,4-epoxycyclohexyl)triethoxysilane, β-(3,4-epoxycyclohexyl)methyldimethoxysilane, β-(3,4-epoxycyclohexyl)ethyldimethoxysilane, condensation products of 3-glycidyloxypropyltrimethoxysilane and condensation products of (3-glycidyloxypropyl) methyldimethoxysilane; and isocyanate group-bearing alkoxysilane compounds such as 3-isocyanatopropyltrimethoxysilane, 3-isocyanatopropyltriethoxysilane, (3-isocyanatopropyl) methyldimethoxysilane, (3-isocyanatopropyl) methyldiethoxysilane, condensation products of 3-isocyanatopropyltrimethoxysilane and condensation products of (3-isocyanatopropyl)methyldimethoxysilane.

A Lewis acid may be added to accelerate the reaction when the above alkoxysilyl group-bearing compound is reacted with active end groups on the polymer. The Lewis acid acts is as a catalyst to promote the coupling reaction, thus improving cold flow by the modified polymer and providing a better shelf stability. Examples of suitable Lewis acids include dialkyltin dialkyl malates, dialkyltin dicarboxylates and aluminum trialkoxides.

Other types of terminal modifiers that may be used include:

(ii) halogenated organometallic compounds, halogenated metallic compounds and organometallic compounds of the general formulas $R^5_nM'X_{4-4}$, $M'X_4$, $M'X_3$, $R^5_n$, $M'(—R^6—COOR^7)_{4-n}$ or $R^5_nM'$ $(—R^6—COR^7)_{4-n}$ (wherein $R^5$ and $R^6$ are each independently a hydrocarbon group of 1 to 20 carbons; $R^7$ is a hydrocarbon group of 1 to 20 carbons which may contain pendant carbonyl or ester groups; M' is a tin, silicon, germanium or phosphorus atom; X is a halogen atom; and n is an integer from 0 to 3);

(iii) heterocumulene compounds having on the molecule a Y=C=Z linkage (wherein Y is a carbon, oxygen, nitrogen or sulfur atom; and Z is an oxygen, nitrogen or sulfur atom);

(iv) three-membered heterocyclic compounds containing on the molecule the following bonds

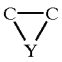

(wherein Y is an oxygen, nitrogen or sulfur atom);

(v) halogenated isocyano compounds;

(vi) carboxylic acids, acid halides, ester compounds, carbonate compounds and acid anhydrides of the formula $R^8—(COOH)_m$, $R^9(COX)_m$, $R^{10}—(COO—R^{11})_m$, $R^{12}—OCOO—R^{13}$, $R^{14}—(COOCO—R^{15})_m$ or

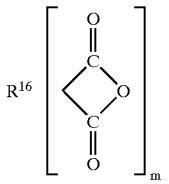

(wherein $R^8$ to $R^{16}$ are each independently a hydrocarbon group of 1 to 50 carbons, X is a halogen atom, and m is an integer from 1 to 5); and (vii) carboxylic acid metal salts of the formula $R^{17}{}_1M''(OCOR^{18})_{4-1}$, $R^{19}{}_1M''(OC0—R^{20}—COOR^{21})_{4-1}$ or

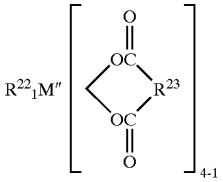

(wherein $R^{17}$ to $R^{23}$ are each independently a hydrocarbon group of 1 to 20 carbons, M" is a tin, silicon or germanium atom, and the letter 1 is an integer from 0 to 3).

Specific examples of the above terminal modifiers and methods for their reaction are described in, for example, JP-A 11-35633, JP-A 7-268132 and JP-A 2002-293996.

The above-mentioned group VIII catalyst is not subject to any particular limitation. Exemplary group VIII catalysts include the following nickel catalysts and cobalt catalysts.

Examples of suitable nickel catalysts include single-component systems such as nickel-kieselguhr, binary systems such as Raney nickel/titanium tetrachloride, and ternary systems such as nickel compound/organometallic compound/boron trifluoride etherate. Exemplary nickel compounds include reduced nickel on a carrier, Raney nickel, nickel oxide, nickel carboxylate and organonickel complex salts. Exemplary organometallic compounds include trialkylaluminum compounds such as triethylaluminum, tri-n-propylaluminum, triisobutylaluminum and tri-n-hexylaluminum; alkyllithium compounds such as n-butyllithium, sec-butyllithium, tert-butyllithium and 1,4-dilithiumbutane; and dialkylzinc compounds such as diethylzinc and dibutylzinc.

Examples of suitable cobalt catalysts include cobalt and cobalt compounds such as Raney cobalt, cobalt chloride, cobalt bromide, cobalt iodide, cobalt oxide, cobalt sulfate, cobalt carbonate, cobalt phosphate, cobalt phthalate, cobalt carbonyl, cobalt acetylacetonate, cobalt diethyldithiocarbamate, cobalt anilinium nitrite and cobalt dinitrosyl chloride. It is particularly advantageous to use these compounds in combination with, for example, a dialkylaluminum monochloride such as diethylaluminum monochloride or diisobutylaluminum monochloride; a trialkylaluminum such as triethylaluminum, tri-n-propylaluminum, triisobutylaluminum or tri-n-hexylaluminum; an alkylaluminum sesquichloride such as ethylaluminum sesquichloride; or aluminum chloride.

Synthesis of the above-described polybutadiene in the invention using the group VIII catalysts described above, and particularly a nickel or cobalt catalyst, can be carried out by a process in which the nickel catalyst or cobalt catalyst typically is continuously charged into a reactor together with a solvent and butadiene monomer, and the reaction conditions are suitably selected, such as a reaction temperature in a range of 5 to 60° C. and a reaction pressure in a range of atmospheric pressure to 70 plus atmospheres, so as to yield a product having the above-indicated Mooney viscosity.

The polybutadiene in the invention has a polydispersity index Mw/Mn (where Mw is the weight-average molecular weight, and Mn is the number-average molecular weight) of generally at least 2.0, preferably at least 2.2, more preferably at least 2.4, and even more preferably at least 2.6, but generally not more than 8.0, preferably not more than 7.5, even more preferably not more than 4.0, and most preferably not more than 3.4. A polydispersity Mw/Mn which is too small may lower the workability, whereas one that is too large may lower the resilience.

Component A in the invention is a base rubber containing a polybutadiene like that described above. The above-described polybutadiene having a cis-1,4 unit content of at least 60% generally accounts for at least 60 wt %, preferably at least 70 wt %, more preferably at least 80 wt %, and most preferably at least 85 wt %, of component A. The content of the above polybutadiene in the base rubber may be as much as 100 wt %, although the polybutadiene content can be set to 95 wt % or less, and in some cases to 90 wt % or less. A base rubber in which the content of polybutadiene having a cis-1,4 unit content of at least 60% is too low may result in the golf ball having a poor rebound.

Rubber components other than the above-described polybutadiene may be included in the base rubber, insofar as the objects of the invention are attainable. Examples of such additional rubber components that may be used include polybutadienes other than the above-described polybutadiene, and other diene rubbers, such as styrene-butadiene rubbers, natural rubbers, isoprene rubbers and ethylene-propylene-diene rubbers.

Component B is an unsaturated carboxylic acid and/or an unsaturated carboxylic acid metal salt. Examples of suitable unsaturated carboxylic acids include acrylic acid, methacrylic acid, maleic acid and fumaric acid. Acrylic acid and methacrylic acid are especially preferred. Examples of suitable unsaturated carboxylic acid metal salts include zinc salts and magnesium salts of the above unsaturated carboxylic acids. Of these, zinc acrylate is especially preferred.

The amount of this component B per 100 parts ("parts" refers hereinafter to parts by weight) of above-described component A is generally at least 10 parts, preferably at least 13 parts, more preferably at least 16 parts, even more preferably at least 18 parts, and most preferably at least 20 parts, but generally not more than 60 parts, preferably not more than 50 parts, more preferably not more than 45 parts, even more preferably not more than 40 parts, and most preferably not more than 35 parts. Too much component B relative to component A may make the ball too hard, giving it an unpleasant feel upon impact. On the other hand, too little component B may make the ball too soft, lowering its flight performance and durability.

Component C in the invention is an organosulfur compound. Exemplary organosulfur compounds include thiophenols, thionaphthols, halogenated thiophenols, and metal salts thereof. Specific examples include pentachlorothiophenol, pentafluorothiophenol, pentabromothiophenol, p-chlorothiophenol, and the zinc salts thereof; diphenylpolysulfides, dibenzylpolysulfides, dibenzoylpolysulfides, dibenzothiazoylpolysulfides and dithiobenzoylpolysulfides having 2 to 4 sulfurs; alkylphenyldisulfides, furan ring-bearing organosulfur compounds and thiophene ring-bearing organosulfur compounds. Diphenyldisulfide and the zinc salt of pentachlorothiophenol are especially preferred. These may be used singly or as combinations of two or more thereof.

The amount of component C (when two or more are used together, the combined amount thereof) per 100 parts by weight of above component A is generally at least 0.1 part, preferably at least 0.2 part, more preferably at least 0.4 part, even more preferably at least 0.7 part, and most preferably at least 0.9 part, but generally not more than 5 parts, preferably not more than 4 parts, more preferably not more than 3 parts, even more preferably not more than 2 parts, and most preferably not more than 1.5 parts. Too little component C may fail to provide a resilience-improving effect, whereas too much may result in an excessively low hardness and thus insufficient resilience.

Component D in the invention is an inorganic filler, illustrative examples of which include zinc oxide, barium sulfate and calcium carbonate. The amount of component D per 100 parts of component A is generally at least 5 parts, preferably at least 7 parts, more preferably at least 10 parts, and most preferably at least 13 parts, but generally not more than 80 parts, preferably not more than 65 parts, more preferably not more than 50 parts, and most preferably not more than 40 parts. The use of too much or too little component D relative to the base rubber serving as component A may make it impossible to achieve a golf ball having an appropriate weight and a desirable rebound.

It is preferable for two or more organic peroxides to be used as component E. If (p) represents the organic peroxide having the shortest half-life at 155° C., (q) represents the organic peroxide having the longest half-life at 155° C., and the half-lives of (p) and (q) are denoted as Pt and $q_t$, respectively, the half-life ratio $q_t/p_t$, is generally at least 7, preferably at least 8, more preferably at least 9, and most preferably at least 10, but generally not more than 20, preferably not more than 18, and more preferably not more than 16. Even with the use of two or more organic peroxides, at a half-life ratio outside of the above range, the desired levels of ball rebound, compression and durability may not be achieved.

Organic peroxide (p) has a half-life $p_t$ at 155° C. of generally at least 5 seconds, preferably at least 10 seconds, and more preferably at least 15 seconds, but generally not more than 120 seconds, preferably not more than 90 seconds, and more preferably not more than 60 seconds. Organic peroxide (q) has a half-life $q_t$ at 155° C. of generally at least 300 seconds, preferably at least 360 seconds, and more preferably at least 420 seconds, but generally not more than 800 seconds, preferably not more than 700 seconds, and more preferably not more than 600 seconds.

Specific examples of the organic peroxides include dicumyl peroxide, 1,1-bis(t-butylperoxy)-3,3,5-trimethylcyclohexane and α, α'-bis(t-butylperoxy) diisopropylbenzene. These organic peroxides may be commercially available products, such as Percumyl D (available from NOF Corporation), Perhexa 3M (NOF Corporation) and Luperco 231XL (available from Atochem Co.). The use of 1,1-bis(t-butylperoxy)-3,3,5-trimethylcyclohexane as above organic peroxide (p) and dicumyl peroxide as above organic peroxide (q) is preferred.

The overall amount of organic peroxide which includes above components (p) and (q) per 100 parts of component A is generally at least 0.1 part, preferably at least 0.2 part, more preferably at least 0.3 part, and even more preferably at least 0.4 part, but generally nor more that 0.8 part, preferably not more than 0.7 part, more preferably not more than 0.6 part, and even more preferably not more than 0.5 part. Too little organic peroxide may increase the time required for crosslinking, substantially lowering productivity during manufacture of the golf ball and also significantly lowering compression. On the other hand, too much organic peroxide may lower the rebound and durability.

It is desirable for the amount of organic peroxide (p) per 100 parts of component A to be generally at least 0.05 part, preferably at least 0.08 part, and more preferably at least 0.1 part, but not more than 0.5 part, preferably not more than 0.4 part, and more preferably not more than 0.3 part. It is desirable for the amount of organic peroxide (q) per 100 parts of component A to be generally at least 0.05 part, preferably at least 0.15 part, and more preferably at least 0.2 part, but generally not more than 0.7 part, preferably not more than 0.6 part, and more preferably not more than 0.5 part.

If necessary, the rubber composition may include also an antioxidant in an amount, per 100 parts of component A, of at least 0.05 part, preferably at least 0.1 part, and more preferably at least 0.2 part, but not more than 3 parts, preferably not more than 2 parts, more preferably not more than 1 part, and most preferably not more than 0.5 part. The antioxidant may be a commercially available product, such as Nocrac NS-6, Nocrac NS-30 (both made by Ouchi Shinko Chemical Industry Co., Ltd.), and Yoshinox 425 (made by Yoshitomi Pharmaceutical Industries, Ltd.).

The core of the inventive golf ball can be obtained by vulcanizing and curing the above-described rubber composition using a method like that employed with known golf ball rubber compositions. For example, vulcanization may be carried out at a temperature of 100 to 200° C. for a period of 10 to 40 minutes.

The envelope layer in the golf ball of the invention is made from a thermoplastic resin. Examples of thermoplastic resins from which the envelope layer may be formed include ionomer resins, ester thermoplastic elastomers, amide thermoplastic elastomers, styrene thermoplastic elastomers, urethane thermoplastic elastomers, olefin thermoplastic elastomers and mixtures thereof. The use of ester thermoplastic elastomers and urethane thermoplastic elastomers, which have the desired hardness and a good resilience, is especially preferred. Specific examples of commercial products that may be used for this purpose include Hytrel (manufactured by DuPont-Toray Co., Ltd.) and Pandex (manufactured by Dainippon Ink & Chemicals, Inc.).

Antioxidants, dispersants such as metal soaps, and other additives may be included in the envelope layer, provided such addition does not compromise the objects of the invention.

To improve the resistance of the ball to cracking, it is advantageous for the intermediate layer and/or cover in the inventive golf ball to be made from respective ionomer resin-containing thermoplastic resins. By using such materials, even when a thin, hard cover is employed on the ball, adhesion between the intermediate layer and cover can be enhanced, making it possible to achieve a better resistance to cracking.

The material formulation of this type making up the intermediate layer is preferably one of the following formulations X, Y and Z.

Formulation X:

(a) 100 parts by weight of an olefin-unsaturated carboxylic acid random copolymer and/or an olefin-unsaturated carboxylic acid-unsaturated carboxylic acid ester random copolymer, (b) 5 to 80 parts by weight of a fatty acid having a molecular weight of at least 280 or a derivative thereof, and (c) 0.1 to 10 parts by weight of a basic inorganic metal compound capable of neutralizing acid groups on components (a) and (b).

Formulation Y:

(d) 100 parts by weight of a metal ion neutralization product of an olefin-unsaturated carboxylic acid random copolymer and/or a metal ion neutralization product of an olefin-unsaturated carboxylic acid-unsaturated carboxylic acid ester random copolymer, (b) 5 to 80 parts by weight of a fatty acid having a molecular weight of at least 280 or a derivative thereof, and (c) 0.1 to 10 parts by weight of a basic inorganic metal compound capable of neutralizing acid groups on components (d) and (b).

Formulation Z:

100 parts by weight of a mixture of (a) an olefin-unsaturated carboxylic acid random copolymer and/or an olefin-unsaturated carboxylic acid-unsaturated carboxylic acid ester random copolymer with (d) a metal ion neutralization product of an olefin-unsaturated carboxylic acid random copolymer and/or a metal ion neutralization product of an olefin-unsaturated carboxylic acid-unsaturated carboxylic acid ester random copolymer. (b) 5 to 80 parts by weight of a fatty acid having a molecular weight of at least 280 or a derivative thereof, and (c) 0.1 to 10 parts by weight of a basic inorganic metal compound capable of neutralizing acid groups on components (a), (d) and (b).

Above component (a) is an olefin-containing copolymer. The olefin in component (a) is exemplified by olefins having at least 2, but not more than 8, and preferably not more than 6, carbons. Specific examples include ethylene, propylene, butene, pentene, hexene, heptene and octene. Ethylene is especially preferred.

The unsaturated carboxylic acid in component (a) is exemplified by acrylic acid, methacrylic acid, maleic acid and fumaric acid. Acrylic acid and methacrylic acid are especially preferred.

The unsaturated carboxylic acid ester in component (a) is exemplified by lower alkyl esters of the foregoing unsaturated carboxylic acids. Specific examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) are especially preferred.

The unsaturated carboxylic acid content ("acid content") within the random copolymer serving as component (a) is generally at least 2 wt %, preferably at least 6 wt %, and more preferably at least 8 wt %, but generally not more than 25 wt %, preferably not more than 20 wt %, and more preferably not more than 15 wt %. An acid content which is too low may result in a decreased resilience, and an acid content which is too high may lower the processability of the material.

Above component (d) can be obtained by partially neutralizing acid groups on the random copolymer of above component (a) with metal ions.

Illustrative examples of metal ions for neutralizing the acid groups include $Na^+$, $K^+$, $Li^+$, $Zn^{2+}$, $Cu^{2+}$, $Mg^{2+}$, $Ca^{2+}$, $Co^{2+}$, $Ni^{2+}$ and $Pb^{2+}$. Preferred metal ions include $Na^+$, $Li^+$, $Zn^{2+}$, $Mg^{2+}$ and $Ca^{2+}$. The use of $Zn^{2+}$ is especially preferred.

The degree of neutralization in component (d) (the ratio of neutralized acid groups as a proportion of all acid groups in component (d)), although not subject to any particular limitation, is generally at least 5 molt, preferably at least 10 mol %, and more preferably at least 20 mol %, but generally not more than 95 molt, preferably not ore than 90 molt, and more preferably not more than 80 mol %, degree of neutralization greater than 95 mol % may result in a diminished moldability, whereas a degree of neutralization below 5 mol % necessitates an increase in the amount of inorganic metal compound serving as component (c), which may be undesirable in terms of cost.

Commercial products can be advantageously used as above components (a) and (d). Specific examples of commercial products that may be used as the random copolymer in above component (a) include Nucrel AN4311, Nucrel AN4318 and Nucrel 1560 (all products of DuPont-Mitsui Polychemicals Co., Ltd.). Commercial products that may be used as the neutralization product of a random copolymer in component (d) include Himilan 1554, Himilan 1557, Himilan 1601, Himilan 1605, Himilan 1706, Himilan 1855, Himilan 1856 and Himilan AM7316 (all products of DuPont-Mitsui Polychemicals Co., Ltd.); and Surlyn 6320, Surlyn 7930 and Surlyn 8120 (all products of E.I. DuPont de Nemours and Company). Of these, zinc-neutralized ionomer resins (e.g., Himilan AM7316) are preferred.

In the invention, above formulation Z is prepared by blending together components (a) and (d). The blending ratio is not subject to any particular limitation, although the weight ratio of component (a) to component (d) (a:d) is generally from 10:90 to 90:10, and preferably from 20:80 to 80:20.

Component (b) is a fatty acid having a molecular weight of at least 280 or a derivative thereof. This component, which has an extremely small molecular weight compared to above components (a) and/or (d), helps improve the flow properties of the heated mixture. Given that the fatty acid (fatty acid derivative) in component (b) has a molecular weight of at least 280 and a high content of acid groups (or derivatives thereof), the loss of resilience due to its addition is small.

This component (b) may be an unsaturated fatty acid (or fatty acid derivative) containing a double bond or triple bond on the alkyl moiety, or it may be a saturated fatty acid (or derivative thereof) in which the bonds on the alkyl moiety are all single bonds.

The number of carbons on the molecule is generally at least 18, but not more than 80, and preferably not more than 40. Too few carbons may compromise the heat resistance and may also make the acid group ratio so high as to keep the desired flow properties from being achieved on account of interactions with acid groups on components (a) and/or (d). On the other hand, too many carbons increases the molecular weight, which may lower the flow properties and make the material difficult to use.

Specific examples of the fatty acid of component (b) include stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred.

Specific examples of the fatty acid derivatives of component (b) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

Alternatively, it is possible to use, as above component (a) and/or component (d) and as component (b), a known metal soap-modified ionomer resin (including those mentioned in U.S. Pat. No. 5,312,857, U.S. Pat. No. 5,306,760 and International Application WO 98/46671.

Component (c) is a basic inorganic metal compound which can neutralize acid groups in component (a) and/or component (d), and in component (b). When component (a) and/or (d) and component (b) are mixed under heating without the inclusion of component (c), fatty acids sometimes form as a result of transesterification. Because the fatty acids that form have a low thermal stability and readily vaporize during molding, they may cause molding defects. Moreover, when these fatty acids adhere to the surface of the molded article, they may substantially lower paint film adhesion. Component (c) is preferably incorporated so as to resolve such problems.

Illustrative examples of basic inorganic metal compounds that may be used as component (c) in the invention include magnesium oxide, magnesium hydroxide, magnesium carbonate, zinc oxide, sodium hydroxide, sodium carbonate, calcium oxide, calcium hydroxide, lithium hydroxide and lithium carbonate. Of these, a monoxide or a hydroxide is desirable. Magnesium oxide and calcium hydroxide, both of which have a high reactivity with ionomer resins, are preferred. Calcium hydroxide is especially preferred.

Here, component (c) neutralizes the acid groups on above component (a), component (b) or component (d). To achieve both a high degree of neutralization and good flow properties, it is advantageous for transition metal ions and alkali metal and/or alkaline earth metal ions to be used together as the metal ions included in component (c). Because transition metal ions have a weaker ionic cohesion than alkali metal ions and alkaline earth metal ions, in addition to neutralizing some of the acid groups in the heated mixture, they can substantially improve the flow properties.

The ratio of the transition metal ions to the alkali metal and/or alkaline earth metal ions, i.e., the molar ratio (transition metal ions):(alkali metal and/or alkaline earth metal ions), is generally from 10:90 to 90:10, and preferably from 20:80 to 80:20. Too low a molar ratio of transition metal ions may fail to provide sufficient improvement in the flow properties. On the other hand, a molar ratio that is too high may lower the resilience.

As described above, the material making up the intermediate layer in the invention is preferably a mixture of component (a) and/or (d) with components (b) and (c). From the standpoint of thermal stability, moldability and resilience, the acid groups in the mixture have a degree of neutralization (the ratio of neutralized acid groups as a proportion of all the acid groups in the material obtained by mixing component (a) and/or (d) with components (b) and (c)) of generally at least 70 molt, preferably at least 80 molt, and more preferably at least 90 mol %. Such a high degree of neutralization effectively inhibits the transesterification that undesirably arises when component (a) and/or (b) are mixed with a fatty acid (or fatty acid derivative) alone and heated, thus making it possible to prevent fatty acid formation. As a result, there can be obtained a material which has a dramatically improved thermal stability, good moldability, and a much higher resilience than prior-art ionomer resins.

Various additives may also be optionally included in the intermediate layer and/or cover material of the inventive golf ball. Examples of such additives include pigments, dispersants, antioxidants, ultraviolet absorbers and light stabilizers.

Moreover, to improve the feel of the golf ball at the time of impact, various non-ionomeric thermoplastic elastomers may be added to the above essential ingredients. Illustrative examples of such non-ionomeric thermoplastic elastomers include olefin thermoplastic elastomers, styrene thermoplastic elastomers, ester thermoplastic elastomers, urethane thermoplastic elastomers and amide thermoplastic elastomers. The use of olefin thermoplastic elastomers and ester thermoplastic elastomers is especially preferred.

Examples of commercial products that may be used as such non-ionomeric thermoplastic elastomers include olefin thermoplastic elastomers such as Dynaron (manufactured by JSR Corporation) and ester thermoplastic elastomers such as Hytrel (manufactured by DuPont-Toray Co., Ltd.).

It is advantageous for formulation X to be composed of 100 parts by weight of component (a); at least 5 parts by weight, and preferably at least 8 parts by weight, but not more than 80 parts by weight, preferably not more than 40 parts by weight, and more preferably not more than 20 parts by weight, of component (b); and at least 0.1 part by weight, and preferably at least 1 part by weight, but not more than 10 parts by weight, and preferably not more than 5 parts by weight, of component (c).

It is advantageous for formulation Y to be composed of 100 parts by weight of component (d); at least 5 parts by weight, and preferably at least 8 parts by weight, but not more than 80 parts by weight, preferably not more than 40 parts by weight, and more preferably not more than 20 parts by weight, of component (b); and at least 0.1 part by weight, and preferably at least 0.5 part by weight, but not more than 10 parts by weight, and preferably not more than 5 parts by weight, of component (c).

It is advantageous for formulation Z to be composed of 100 parts by weight of components (a) and (d); at least 5 parts by weight, and preferably at least 8 parts by weight, but not more than 80 parts by weight, preferably not more than 40 parts by weight, and more preferably not more than 20 parts by weight, of component (b); and at least 0.1 part by weight, and preferably at least 0.7 part by weight, but not more than 10 parts by weight, and preferably not more than 5 parts by weight, of component (c).

In each of the above formulations X to Z, too little component (b) may lower the melt viscosity and reduce processability, whereas too much may lower the durability. Too little component (c) may fail to yield an observable improvement in thermal stability and resilience, whereas too much results in an excessive amount of basic inorganic metal compound, which may actually diminish the heat resistance of the heated mixture and make it more troublesome to use.

The amount of ionomer resin in the thermoplastic resin making up the intermediate layer is generally at least 30 wt %, preferably at least 40 wt %, and more preferably at least 50 wt %. The upper limit is generally 100 wt %, preferably not more than 90 wt %, and more preferably not more than 80 wt %. The amount of ionomer resin in the thermoplastic resin making up the cover is generally at least 50 wt %, preferably at least 70 wt %, and more preferably at least 80 wt %. If the ionomer resin content within the thermoplastic resin making up the intermediate layer or cover falls outside the above range, the golf ball may have a lower resistance to cracking and a lower rebound.

It is preferable to use above formulation X, Y or Z as the thermoplastic resin formulation making up the intermediate layer. By using a highly neutralized ionomer resin in the intermediate layer, there can be obtained an intermediate layer which is both soft and has a high resilience.

It is desirable to include barium sulfate in the thermoplastic resin making up the cover. The amount included per 100 parts by weight of the cover material is generally at least 5 parts by weight, preferably at least 10 parts by weight, and more preferably at least 15 parts by weight, but generally not more than 35 parts by weight, preferably not more than 30 parts by weight, and more preferably not more than 25 parts by weight. By including such an amount of barium sulfate in the cover material, the resistance of the golf ball to cracking can be improved.

The intermediate layer material and/or cover material may be prepared from above-described formulation X, formulation Y or formulation Z by heating and working together the components in accordance with a known method using an internal mixer such as a twin-screw extruder, Banbury mixer or kneader, and under suitable heating and mixing conditions, such as a temperature of 150 to 250° C. If any additives are to be included in the material, a heating and mixing method may be used in which such additives are added at the same time as the above components to be mixed or are added after first mixing together the components of the particular formulation (X, Y or Z) being employed.

The golf ball of the invention is produced using the above-described envelope layer material, intermediate layer material and/or cover material. The envelope layer, intermediate layer and cover may each be formed by any suitable process, such as injection molding or compression molding. When an injection molding process is employed, this may involve precisely positioning a prefabricated solid core within a mold, then injecting the above-described material into the mold. When a compression molding process is employed, this may involve fabricating a pair of half-cups from the above material, enclosing the core within these cups, either directly or together with an intervening envelope layer and intermediate layer, then molding under heat and pressure in a mold.

In the invention, a golf ball having a core, an envelope layer enclosing the core, an intermediate layer enclosing the envelope layer, and a cover enclosing the intermediate layer is formed using each of the above-described materials. The golf ball of the invention also satisfies following conditions (1) to (9):

(1) the thermoplastic resin from which the envelope layer is made has a rebound resilience, as measured in accordance with BS 903, of at least 65;
(2) the envelope layer has a thickness of at least 0.5 mm but less than 1.5 mm;
(3) the envelope layer has a Shore D hardness of at least 5 but less than 30;
(4) the intermediate layer has a thickness of at least 0.5 mm but less than 1.5 mm;
(5) the intermediate layer has a Shore D hardness of at least 40 but less than 56;
(6) the cover has a thickness of at least 0.5 mm but less than 1.5 mm;
(7) the cover has a Shore D hardness of at least 56 and but not more than 70;
(8) the envelope layer, intermediate layer and cover have a combined thickness of at least 1.5 mm but less than 4.5 mm; and
(9) when the shore hardness at the center of the core, the Shore D hardness at the surface of the core, the Shore D hardness of the envelope layer, the Shore D hardness of the intermediate layer and the Shore D hardness of the cover are compared, the envelope layer has the lowest Shore D hardness. By satisfying the above conditions, there can be obtained a golf ball which has a high durability yet also has a high rebound, a high launch angle, a low spin and a good feel upon impact.

To provide golf balls having even better properties, it is preferable to additionally satisfy following conditions (10) to (13):

(10) the core has a deflection when subjected to a load of 100 kg of at least 3.0 mm but not more than 6.0 mm;
(11) 3≦(Shore D hardness of cover)−(Shore D hardness of intermediate layer)≦30;
(12) 10≦(Shore D hardness of intermediate layer)−(Shore D hardness of envelope layer)≦45; and
(13) the intermediate layer and cover layer have melt flow rates of at least 1.6 dg/min.

Condition (1):

In the golf ball of the invention, the thermoplastic resin from which the envelope layer is formed has a rebound resilience, as measured in accordance with BS 390, of at least 65, preferably at least 68, and more preferably at least 70. The objects of the invention are not attainable at a rebound resilience of less than 65 because the resulting ball has a poor rebound and a short carry.

Condition (2):

In the golf ball of the invention, the envelope layer has a thickness of at least 0.5 mm, preferably at least 0.7 mm, and more preferably at least 0.8 mm, but less than 1.5 mm, and preferably less than 1.3 mm. The objects of the invention are not attainable at an envelope layer thickness of less than 0.5 mm because the desired softness and high rebound cannot both be achieved in the resulting ball. Nor are the objects of the invention attainable at an envelope layer thickness of 1.5 mm or more, owing to the low rebound of the resulting ball.

Condition (3):

In the golf ball of the invention, the envelope layer has a Shore D hardness of at least 5, preferably at least 7, and more preferably at least 10, but less than 30, preferably 20 or less, and most preferably 15 or less. The objects of the invention cannot be attained at an envelope layer Shore D hardness of less than 5 because the resulting ball has a low rebound. The objects of the invention are also not attainable at a value of 30 or more because the desired softness and high rebound cannot both be achieved in the resulting ball.

The invention employs a structure composed of a core enclosed within an envelope layer which, as a golf ball material that satisfies above conditions (1) to (3), is very soft, has a high resilience and has a thickness within a specific range. By additionally enclosing such a special envelope layer-enclosed core within the optimized intermediate layer and cover that are subsequently described, a given amount of deformation is ensured when the ball is hit, enabling a low spin and a high launch angle to be achieved. In addition, deformation is concentrated in the envelope layer, thereby suppressing unnecessary and excessive deformation by the core which contributes significantly to rebound by the ball, and in turn checking a decrease in initial velocity when the golf ball is hit. In other words, this arrangement enables a high rebound, a high launch angle and a low spin to all be achieved to a considerable degree.

Condition (4):

In the golf ball of the invention, the intermediate layer has a thickness of at least 0.5 mm, preferably at least 0.7 mm, and more preferably at least 0.8 mm, but less than 1.5 mm, and preferably less than 1.3 mm. The objects of the invention cannot be achieved at an intermediate layer thickness of less than 0.5 mm because the resulting ball has a low rebound and a poor cracking resistance. The objects of the invention also cannot be achieved at an intermediate layer thickness of 1.5 mm or more because the resulting ball has a low rebound and a hard feel.

Condition (5):

In the golf ball of the invention, the intermediate layer has a Shore D hardness of at least 40, and preferably at least 42, but less than 56, preferably 52 or less, and more preferably 47 or less. The objects of the invention cannot be achieved at an intermediate layer Shore D hardness of less than 40 because the ball has less rebound and more spin. Nor can the objects of the invention be achieved at an intermediate layer Shore D hardness of 56 or more, owing to the hard feel of the resulting ball.

Condition (6);

In the golf ball of the invention, the cover has a thickness of at least 0.5 mm, preferably at least 0.7 mm, and more preferably at least 0.8 mm, but less than 1.5 mm, and preferably less than 1.3 mm. The objects of the invention cannot be achieved at a cover thickness of less than 0.5 mm, owing to the low rebound and low cracking resistance of the resulting ball. Nor can the objects of the invention be achieved at a cover thickness of 1.5 mm or more, because the resulting ball has too hard a feel.

Condition (7):

In the golf ball of the invention, the cover has a Shore D hardness of at least 56, preferably at least 58, and more preferably at least 60, but not more than 70, preferably not more than 68, and more preferably not more than 65. The objects of the invention cannot be achieved at a cover Shore D hardness of less than 56 because the resulting ball has a lower rebound, increased spin, and a shorter distance. Nor can the objects be achieved at a cover Shore D hardness of more than 70, owing to the hard feel of the resulting ball.

Condition (8):

In the golf ball of the invention, the envelope layer, intermediate layer and cover have a combined thickness of at least 1.5 mm, preferably at least 2.0 mm, and more preferably at least 2.4 mm, but less than 4.5 mm, preferably 4.2 mm or less, and more preferably 3.6 mm or less. The objects of the invention cannot be achieved at a combined thickness of less than 1.5 mm because the envelope layer, intermediate layer and cover in the resulting ball are each too thin to exhibit their respective effects. Nor can the objects of the invention be achieved at an overall thickness of 4.5 mm or more because the resulting ball has a core diameter which is too small, giving the ball a low rebound and a poor feel.

Condition (9):

In the golf ball of the invention, when the Shore D hardness at the center of the core, the Shore D hardness at the surface of the core, the Shore D hardness of the envelope layer, the Shore D hardness of the intermediate layer and the Shore D hardness of the cover are compared, the envelope layer has the lowest Shore D hardness. If such a relationship is not satisfied, the objects of the invention cannot be achieved because the resulting golf ball will not have both a soft feel and a high rebound.

In the invention, an intermediate layer and a cover which satisfy above conditions (4) to (9) surrounds the special envelope layer-enclosed core which satisfies above conditions (1) to (3). Although the special envelope layer-enclosed core can itself contribute to a high rebound, high launch angle and low spin, stress at the time the golf ball is hit is readily transmitted in the direction of ball rotation, which tends to increase golf ball spin. Moreover, if there is a large difference between the resilience of the envelope layer and the resilience of the intermediate layer, distortion that arises at the boundary between the envelope layer and the intermediate layer may lead to boundary separation (lowering the durability of the golf ball).

Therefore, in this invention, by using the specific materials described above to make the intermediate layer and the cover and by setting the respective thicknesses and hardnesses of the intermediate layer and the cover within specific ranges, it is possible to compensate for any drawbacks that may arise from the use of a special envelope layer-enclosed core like that described above.

Condition (10):

In the golf ball of the invention, the core has a deflection when subjected to a load of 100 kg of at least 3.0 mm, preferably at least 3.2 mm, and more preferably at least 3.5 mm, but generally not more than 6.0 mm, preferably not more than 5.0 mm and more preferably not more than 4.5 mm. At a core deflection when subjected to a load of 100 kg of less than 3.0 mm, the feel may be too hard and the spin may increase, shortening the carry of the ball. On the other hand, at a core deflection of more than 6.0 mm, the resulting golf ball may have a lower rebound and a lower resistance to cracking.

Condition (11):

In the golf ball of the invention, the value (Shore D hardness of cover)−(Shore D hardness of intermediate layer) is generally at least 3, preferably at least 8, and more preferably at least 18, but generally not more than 30, preferably not more than 28, and more preferably not more than 25. If this value falls outside the above range, the resulting golf ball may fail to achieve a good balance between a high rebound, a low spin and a soft feel.

Condition (12);

In the golf ball of the invention, the value (Shore D hardness of intermediate layer)−(Shore D hardness of envelope layer) is generally at least 10, preferably at least 15, and more preferably at least 25, but generally not more than 45, preferably not more than 40, and more preferably not more than 35. If this value falls outside the above range, the resulting golf ball may fail to achieve a good balance between a high rebound and a soft feel.

Condition (13):

In the golf ball of the invention, the melt flow rates (sometimes abbreviated hereinafter as "MFR") of the intermediate layer and cover layer are generally at least 1.6 dg/min, preferably at least 1.8 dg/min, and more preferably at least 2.5 dg/min. At a melt flow rate of less than 1.6 dg/min, molding may be difficult and the molded ball may have a reduced sphericity, which can increase the variability of flight. "Melt flow rate," as used herein, refers to the value measured in general accordance with JS-K6760 at a test temperature of 190° C. and a test load of 21.18 N (2.16 kgf).

When such intermediate layer and cover materials having good flow properties are used, a good moldability can be achieved even when the layer being molded is thin.

In the golf ball of the invention, the core diameter is generally at least 33.7 mm, preferably at least 34.3 mm, and more preferably at least 35.5 mm, but generally not more than 39.7 mm, preferably not more than 38.7 mm, and more preferably not more than 37.9 mm. The core used in the invention is a high-resilience core formulated as described above. By making this type of core which contributes substantially to the ball's rebound relatively large, the golf ball can achieve an even longer carry.

The surface of the inventive ball may have numerous dimples formed thereon by a conventional method. No particular limitation is imposed on dimple characteristics such as shape and total number. For example, the dimples arranged on a single ball may be all of one type, or may be of two or more types, and preferably two to six or more types, of differing diameter and/or depth. Regardless of whether there are differing types of dimples, it is recommended that the dimple diameter be in a range of generally 2.0 to 5.0 mm, and preferably 2.2 to 4.5 mm. The dimple shape can be adjusted so as to give a depth in a range of generally 0.1 to 0.3 mm, and preferably 0.11 to 0.25 mm. The total number of these dimples can be set at generally from 250 to 500, and preferably from 300 to 470. The dimples are generally circular in shape, although they may have other shapes which are non-circular, such as elliptical, oval or polygonal shapes. The surface of the ball may be administered various treatment such as surface preparation, stamping and painting. Such operations can be easily carried out, particularly when performed on a cover made of the above-described heated mixture.

The golf ball of the invention can be manufactured in accordance with the Rules of Golf for use in competitive play, in which case the ball may be formed to a diameter of not less than 42.67 mm and a weight of not more than 45.93 g. The upper limit in the diameter is preferably not more than 44.0 mm, more preferably not more than 43.5 mm, and most preferably not more than 43.0 mm. The lower limit in the weight is preferably not less than 44.5 g, more preferably not less than 45.0 g, even more preferably not less than 45.1 g, and most preferably not less than 45.2 g.

EXAMPLE

The following Examples and Comparative Examples are provided by way of illustration and not by way of limitation.

Examples 1 to 5, and Comparative Examples 1 to 6

Rubber compositions having the formulations (in parts by weight) shown in Table 1 were valcanized to form the cores of four-piece golf balls. Vulcanization was carried out at 155° C., for 15 minutes.

Envelope layer materials, intermediate layer materials and cover materials of the formulations shown in Tables 2 and 3 were injection molded over these cores to form four-piece solid golf balls. Table 4 shows the results of evaluations carried out on the resulting golf balls.

The materials mentioned in Table 1 are described below.

BR730: A polybutadiene rubber produced by JSR Corporation.

Polymerization catalyst, neodymium system; cis-1,4 unit content, 96%; Mooney viscosity ($ML_{1+4}$ (100° C.)), 55.

BR01: A polybutadiene rubber produced by JSR Corporation.

Polymerization catalyst, nickel system; cis-1,4 unit content, 96%; Mooney viscosity ($ML_{1+4}$ (100° C.)), 44.

BR11: A polybutadiene rubber produced by JSR Corporation.

Polymerization catalyst, nickel system; cis-1,4 unit content, 96%; Mooney viscosity ($ML_{1+4}$ (100° C.)), 44.

Perhexa 3M-40: An organic peroxide (40% dilution) produced by NOF Corporation.

Percumil D: An organic peroxide produced by NOF Corporation.

Nocrac NS-6: An antioxidant produced by Ouchi Shinko Chemical Industry Co., Ltd.

TABLE 2

| Components | Envelope layer/Intermediate layer/Cover formulations | | | | | | | |
|---|---|---|---|---|---|---|---|---|
| (pbw) | a | b | c | d | e | f | g | h |
| Hytrel HTD274 | 100 | | | | | | | |
| Hytrel HTD237 | | 100 | | | | | | |
| Hytrel 3078 | | | 100 | | | | | |
| Hytrel 4001 | | | | 100 | | | | |
| Hytrel SB754 | | | | | 100 | | | |
| Hytrel 4701 | | | | | | | | |
| Dynaron 6100P | | | | | | 25 | | |
| Dynaron 6200 | | | | | | | 30 | |
| Dynaron 4630 | | | | | | | 10 | |
| Nucrel | | | | | | | 60 | |
| AN4318 | | | | | | | | |
| Surlyn 8120 | | | | | | 75 | | |
| Surlyn 9945 | | | | | | | | |
| Surlyn 6320 | | | | | | | | |
| Surlyn 8320 | | | | | | | | 100 |
| Himilan 1601 | | | | | | | | |
| Himilan 1557 | | | | | | | | |
| Himilan 1706 | | | | | | | | |
| Himilan 1605 | | | | | | | | |
| Behenic acid | | | | | | 20 | 20 | 20 |

TABLE 1

| Components | | Core formulations | | | | | | | | |
|---|---|---|---|---|---|---|---|---|---|---|
| | (pbw) | A | B | C | D | E | F | G | H | I |
| Base rubber | BR730 | 100 | 100 | 100 | 100 | | | | 100 | 100 |
| | BR01 | | | | | 50 | 50 | 50 | | |
| | BR11 | | | | | 50 | 50 | 50 | | |
| Metal salt of unsaturated carboxylic acid | Zinc acrylate | 26.9 | 25.3 | 27.8 | 27.0 | 19.1 | 27.0 | 25.3 | 27.7 | 27.2 |
| Organosulfur compound | Zinc salt of pentachlorothiophenol | 1.0 | 1.0 | 1.0 | 1.0 | | | | 1.0 | 1.0 |
| Inorganic fillers | Zinc oxide | 33.6 | 28.2 | 24.2 | 24.2 | 5.0 | 5.0 | 5.0 | 16.8 | 22.3 |
| | Barium sulfate | | | | | 20.1 | 28.5 | 38.3 | | |
| Organic peroxides | Perhexa 3M-40 | 0.3 | 0.3 | 0.3 | 0.3 | 0.45 | 0.45 | 0.6 | 0.3 | 0.3 |
| | Percumil D | 0.3 | 0.3 | 0.3 | 0.3 | 0.45 | 0.45 | 0.6 | 0.3 | 0.3 |
| Antioxidant | Nocrac NS-6 | 0.1 | 0.1 | 0.1 | 0.1 | 0.2 | 0.2 | 0.2 | 0.1 | 0.1 |

TABLE 2-continued

| Components (pbw) | Envelope layer/Intermediate layer/Cover formulations a | b | c | d | e | f | g | h |
|---|---|---|---|---|---|---|---|---|
| Calcium hydroxide | | | | | | 2.3 | 3.5 | 2.6 |
| Titanium dioxide | | | | | | | 2 | |
| Barium sulfate 300 | | | | | | | | |
| MFR (dg/min) | | | | | | 2.1 | 2.3 | 2.0 |

TABLE 3

| Components (pbw) | Envelope layer/Intermediate layer/Cover formulations i | j | k | l | m | n | o | p |
|---|---|---|---|---|---|---|---|---|
| Hytrel HTD274 | | | | | | | | |
| Hytrel HTD237 | | | | | | | | |
| Hytrel 3078 | | | | | | | | |
| Hytrel 4001 | | | | | | | | |
| Hytrel SB754 | | | | | | | | |
| Hytrel 4701 | | | 100 | | | | | |
| Dynaron 6100P | | | | | | | | |
| Dynaron 6200 | | | | | | | | |
| Dynaron 4630 | | | | | | | | |
| Nucrel | | | | | | | | |
| AN4318 | | | | | | | | |
| Surlyn 8120 | | 55 | | | | | | 45 |
| Surlyn 9945 | | | | 25 | | 25 | | |
| Surlyn 6320 | | | | | | | | |
| Surlyn 8320 | | | | | | | | |
| Himilan 1601 | 50 | | | | | | 50 | |
| Himilan 1557 | 50 | | | | 50 | | 50 | |
| Himilan 1706 | | 45 | | 25 | | 25 | | 55 |

TABLE 3-continued

| Components (pbw) | Envelope layer/Intermediate layer/Cover formulations i | j | k | l | m | n | o | p |
|---|---|---|---|---|---|---|---|---|
| Himilan 1605 | | | | 50 | 50 | 50 | | |
| Behenic acid | | | | | | | | |
| Calcium hydroxide | | | | | | | | |
| Titanium dioxide | 2 | 2 | | 2 | 2 | 2 | 5.6 | 2 |
| Barium sulfate 300 | | | | | 20 | 20 | 28 | |
| MFR (dg/min) | 3.1 | 0.8 | 11.0 | 4.0 | 3.2 | 3.3 | 2.3 | 0.8 |

The materials mentioned in Tables 2 and 3 are described below. In the tables, "MFR" refers to the melt flow rate measured in general accordance with JIS-K6760 at a test temperature of 190° C. and a test load of 21.18 N (2.16 kgf).

Hytrel: Polyester elastomers produced by DuPont-Toray Co., Ltd.

Dynaron: Hydrogenated polymers produced by JSR Corporation.

Nucrel: hydrogenated polymer resins produced by DuPont-Mitsui Polychemicals Co., Ltd.

Surlyn: Ionomer resins produced by E.I. DuPont de Nemours and Company.

Himilan: Ionomer resins produced by DuPont-Mitsui Polychemicals Co., Ltd.

Behenic acid: NAA222-S (beads), produced by NOF Corporation. Calcium hydroxide: CLS-B, produced by Shiraishi Kogyo Kaisha, Ltd.

Barium sulfate 300: Precipitated barium sulfate, produced by Sakai Chemical Industry Co., Ltd.

TABLE 4

| | | Example 1 | 2 | 3 | 4 | 5 | Comparative Example 1 | 2 | 3 | 4 | 5 | 6 |
|---|---|---|---|---|---|---|---|---|---|---|---|---|
| Core | Diameter (mm) | 35.3 | 35.3 | 35.2 | 36.3 | 36.3 | 33.7 | 33.7 | 32.7 | 33.7 | 36.3 | 36.3 |
| | Formulation | A | B | C | D | D | E | F | G | F | H | I |
| | Hardness (100 kg load) (mm) | 3.8 | 4.3 | 3.8 | 4.0 | 4.0 | 5.4 | 3.4 | 3.7 | 3.4 | 4.0 | 4.0 |
| | Center hardness (Shore D) | 34 | 33 | 34 | 33.5 | 33.5 | 28 | 35 | 34 | 35 | 33 | 33.5 |
| | Surface hardness (Shore D) | 41 | 39 | 41 | 39 | 39 | 32 | 43 | 41 | 43 | 39 | 39 |
| Envelope layer | Thickness (mm) | 1.20 | 1.20 | 1.00 | 1.00 | 1.00 | 1.50 | 1.50 | 1.50 | 1.50 | 1.00 | 1.00 |
| | Hardness (Shore D) | 12 | 12 | 12 | 22 | 12 | 30 | 40 | 30 | 40 | 12 | 27 |
| | Formulation | a | a | a | b | a | c | d | c | d | a | e |
| | Rebound resilience (%) | 70 | 70 | 70 | 70 | 70 | 75 | 68 | 75 | 68 | 70 | 56 |
| Sphere formed by enclosing core with envelope layer | Diameter (mm) | 37.7 | 37.7 | 38.2 | 38.3 | 38.3 | 36.7 | 36.7 | 35.7 | 36.7 | 38.3 | 38.3 |
| Intermediate layer | Thickness (mm) | 1.25 | 1.25 | 1.00 | 1.00 | 1.00 | 1.50 | 1.50 | 1.50 | 1.50 | 1.00 | 1.00 |
| | Hardness (Shore D) | 51 | 51 | 42 | 43 | 47 | 59 | 53 | 51 | 51 | 47 | 43 |
| | Formulation | f | f | g | g | h | i | j | f | f | k | g |
| Sphere formed by enclosing envelope layer with intermediate layer | Diameter (mm) | 40.2 | 40.2 | 40.2 | 40.3 | 40.3 | 39.7 | 39.7 | 38.7 | 39.7 | 40.3 | 40.3 |

TABLE 4-continued

| | | Example | | | | | Comparative Example | | | | | |
|---|---|---|---|---|---|---|---|---|---|---|---|---|
| | | 1 | 2 | 3 | 4 | 5 | 1 | 2 | 3 | 4 | 5 | 6 |
| Cover | Thickness (mm) | 1.25 | 1.25 | 1.25 | 1.20 | 1.20 | 1.50 | 1.50 | 2.00 | 1.50 | 1.20 | 1.20 |
| | Hardness (Shore D) | 63 | 63 | 65 | 63 | 65 | 62 | 55 | 59 | 53 | 65 | 63 |
| | Formulation | i | m | n | m | n | c | p | i | j | n | m |
| Ball | Diameter (mm) | 42.7 | 42.7 | 42.7 | 42.7 | 42.7 | 42.7 | 42.7 | 42.7 | 42.7 | 42.7 | 42.7 |
| | Combined thickness of envelope layer, intermediate layer and cover (mm) | 3.70 | 3.70 | 3.25 | 3.20 | 3.20 | 4.50 | 4.50 | 5.00 | 4.50 | 3.20 | 3.20 |
| | Weight (g) | 45.3 | 45.3 | 45.3 | 45.3 | 45.3 | 45.3 | 45.3 | 45.3 | 45.3 | 45.3 | 45.3 |
| | Hardness (100 kg load) (mm) | 3.3 | 3.6 | 3.5 | 3.5 | 3.5 | 4.0 | 2.9 | 3.0 | 3.1 | 3.5 | 3.4 |
| Flight | Spin (rpm) | 2500 | 2440 | 2480 | 2450 | 2430 | 2450 | 2650 | 2580 | 2650 | 2530 | 2440 |
| | Launch angle (°) | 10.7 | 10.8 | 10.7 | 10.8 | 10.8 | 10.8 | 10.4 | 10.5 | 10.4 | 10.6 | 10.8 |
| | Initial velocity (m/s) | 65.0 | 64.8 | 64.9 | 64.9 | 64.9 | 63.5 | 63.9 | 64.2 | 64.2 | 64.5 | 64.5 |
| | Carry (m) | 226.0 | 225.8 | 226.0 | 225.5 | 226.2 | 219.0 | 220.1 | 222.0 | 221.5 | 223.2 | 223.0 |
| Resistance to cracking | | good | good | good | good | good | good | good | good | good | NG | good |
| Feel | When hit with a driver | soft | soft | soft | soft | soft | soft | hard | ordinary | ordinary | soft | soft |
| | When putting | soft | soft | soft | soft | soft | ordinary | soft | ordinary | soft | soft | soft |

The properties shown in Table 4 were evaluated as follows.

Hardness (100 kg Load) (Core, Ball)

Deflection when a load of 100 kg is applied.

Hardness (Core Surface, Core Center, Envelope Layer, Intermediate Layer, Cover)

The Shore D hardness, as measured with an ASTM D2240 type D durometer. The hardness at the surface of the core was measured directly. The hardness at the center of the core was measured after cutting the core in half. The hardnesses of the envelope layer, intermediate layer and cover were each measured as the surface hardness of a resin sheet in accordance with JIS-K6253, not the hardness at the surface of the ball.

Ball Diameter

The maximum diameter of the golf ball, as measured in a dimple-free area on the ball's surface.

Envelope Layer Thickness

Calculated as the following value:

[(diameter of sphere formed by enclosing core with envelope layer)−(core diameter)]/2.

Intermediate Layer Thickness

Calculated as the following value:

[(diameter of sphere formed by enclosing envelope layer with intermediate layer)−(diameter of sphere formed by enclosing core with envelope layer)]/2.

Cover Thickness

Calculated as the following value:

[(ball diameter)−(diameter of sphere formed by enclosing envelope layer with intermediate layer)]/2.

Rebound Resilience

The rebound resilience of the thermoplastic resin which forms the envelope layer, as measured in accordance with British Standard 903.

Flight

The spin, launch angle, initial velocity and carry were measured when the ball was hit at a head speed of 45 m/s with a driver (X-DRIVE TYPE 300 PROSPEC, made by Bridgestone Sports Co., Ltd.; loft angle, 9°) mounted on a swing robot (Miyamae Co., Ltd.). To measure the spin, launch angle and initial velocity, the ball immediately after impact was photographed using a high-speed camera.

Resistance to Cracking

The ball was repeatedly shot against an iron plate at a velocity of 43 m/s, and the number of impacts until the ball cracked was measured. A commercial ball (PRECEPT Laddie, manufactured by Bridgestone Sports Co., Ltd.) was measured at the same time. The results were rated according to the following criteria.

Good: Results were better than "Ordinary."

Ordinary: Number of impacts until ball cracked was within ±5% that for PRECEPT Laddie Not good (NG): Results were worst than "Ordinary."

Feel

The feel of the ball was sensory evaluated by five skilled amateur golfers having handicaps of less than 10, with each golfer assigning the ball a numerical score as follows.

5 points: Very soft;

4 points: Soft 3 points: Ordinary; that is, neither hard nor soft 2 points: Somewhat hard 1 point: Hard.

The average score for each ball was calculated, and the feel was rated based on the following criteria.

Soft: Average score for five golfers was 4 or higher

Ordinary: Average score for five golfers was at least 2, but less than 4

Hard: Average score for five golfers was less than 2.

The golf ball in Comparative Example 1 has a somewhat hard envelope layer and intermediate layer, and the core is too soft. Also, the envelope layer, intermediate layer and cover are somewhat thick, making the core rather small. In addition, the core formulation has a poor resilience. The result is a golf ball having a small rebound and a short carry. This golf ball also has a somewhat hard feel during putting.

The golf ball in Comparative Example 2 has a soft cover, a hard envelope layer and a somewhat hard core. Also, the envelope layer, intermediate layer and cover are somewhat thick, making the core rather small. In addition, the core formulation has a poor resilience. The result is a golf ball having a high spin, a small rebound, and thus a short carry. This golf ball also has a hard feel on full shots such as with a driver.

The golf ball in Comparative Example 3 has a thick envelope layer, intermediate layer and cover, in addition to which the envelope layer is hard and the core formulation has a poor resilience. The result is a golf ball that has a low rebound and a short carry. This golf ball also has a somewhat hard feel.

The golf ball in Comparative Example 4 has a soft cover, a hard envelope layer, and a somewhat hard core. Moreover, the envelope layer, intermediate layer and cover are somewhat thick, making the core rather small. In addition, the core formulation has a poor resilience. The result is a golf ball having a high spin, a low rebound, and thus a short carry.

In the golf ball in Comparative Example 5, the intermediate layer is made of polyester and has a poor adhesion with the cover, lowering the resistance of the ball to cracking. Moreover, the resilience is lower than that of the highly neutralized ionomer used in Example 5 of the invention, increasing the spin and resulting in a short carry.

In the golf ball in comparative example 6, the envelope layer has a low rebound resilience, giving the ball a small rebound and thus resulting in a short carry.

What is claimed is:

1. A golf ball comprising a core, an envelope layer enclosing the core, an intermediate layer enclosing the envelope layer and a cover enclosing the intermediate layer, characterized in that the core is obtained by molding and vulcanizing a rubber composition comprising 100 parts by weight of a base rubber which includes 60 to 100 wt % of a polybutadiene of at least 60% cis-1,4 structure, has a Mooney viscosity ($ML_{1+4}$ (100° C.)) of at least 40 and is synthesized using a rare earth catalyst, 10 to 60 parts by weight of an unsaturated carboxylic acid and/or an unsaturated carboxylic acid metal salt, 0.1 to 5 parts by weight of an organosulfur compound, 5 to 80 parts by weight of an inorganic filler and 0.1 to 0.8 part by weight overall of at least two different organic peroxides which have, letting the organic peroxide with the shortest half-life at 155° C. be (p), the organic peroxide with the longest half-life at 155° C. be (q), the half-life of (p) be $P_t$ and the half-life of (q) be $q_t$, a half-life ratio $q_t/p_t$, of at least 7 but not more than 20, the envelope layer is made from a thermoplastic resin, the intermediate layer is made from a thermoplastic resin containing at least 30 wt % of an ionomer resin, and the cover is made from a thermoplastic resin containing at least 50 wt % of an ionomer resin;

and in that the golf ball satisfies following conditions (1) to (9):

(1) the thermoplastic resin from which the envelope layer is made has a rebound resilience, as measured in accordance with British Standard 903 (BS 903), of at least 65, (2) the envelope layer has a thickness of at least 0.5 mm but less than 1.5 mm, (3) the envelope layer has a Shore D hardness of at least 5 but less than 30, (4) the intermediate layer has a thickness of at least 0.5 mm but less than 1.5 mm, (5) the intermediate layer has a Shore D hardness of at least 40 but less than 56, (6) the cover has a thickness of at least 0.5 mm but less than 1.5 mm, (7) the cover has a Shore D hardness of at least 56 and but not more than 70, (8) the envelope layer, intermediate layer and cover have a combined thickness of at least 1.5 mm but less than 4.5 mm, and (9) when the Shore D hardness at the center of the core, the Shore D hardness at the surface of the core, the Shore D hardness of the envelope layer, the Shore D hardness of the intermediate layer and the Shore D hardness of the cover are compared, the envelope layer has the lowest Shore D hardness.

2. The golf ball of claim 1 which additionally satisfies following condition (10):

(10) the core has a deflection when subjected to a load of 100 kg of at least 3.0 mm but not more than 6.0 mm.

3. The golf ball of claim 1, wherein the thermoplastic resin making up the envelope layer is an ester thermoplastic elastomer.

4. The golf ball of claim 1 which additionally satisfies following conditions (11) and (12):

(11) 3≦(Shore D hardness of cover)−(Shore D hardness of intermediate layer)≦30, and

(12) 10≦(Shore D hardness of intermediate layer)−(Shore D hardness of envelope layer)≦45.

5. The golf ball of claim 1 which additionally satisfies following condition (13):

(13) the intermediate layer and cover layer have melt flow rates of at least 1.6 dg/min.

6. The golf ball of claim 1, wherein the intermediate layer is composed of (a) 100 parts by weight of an olefin-unsaturated carboxylic acid random copolymer and/or an olefin-unsaturated carboxylic acid-unsaturated carboxylic acid ester random copolymer, (b) 5 to 80 parts by weight of a fatty acid having a molecular weight of at least 280 or a derivative thereof, and (c) 0.1 to 10 parts by weight of a basic inorganic metal compound capable of neutralizing acid groups on components (a) and (b).

7. The golf ball of claim 1, wherein the intermediate layer is composed of (d) 100 parts by weight of a metal ion neutralization product of an olefin-unsaturated carboxylic acid random copolymer and/or a metal ion neutralization product of an olefin-unsaturated carboxylic acid-unsaturated carboxylic acid ester random copolymer, (b) 5 to 80 parts by weight of a fatty acid having a molecular weight of at least 280 or a derivative thereof, and (c) 0.1 to 10 parts by weight of a basic inorganic metal compound capable of neutralizing acid groups on components (d) and (b).

8. The golf ball of claim 1, wherein the intermediate layer is composed of 100 parts by weight of a mixture of (a) an olefin-unsaturated carboxylic acid random copolymer and/or an olefin-unsaturated carboxylic acid-unsaturated carboxylic acid ester random copolymer with (d) a metal ion neutralization product of an olefin-unsaturated carboxylic acid random copolymer and/or a metal ion neutralization product of an olefin-unsaturated carboxylic acid-unsaturated carboxylic acid ester random copolymer, (b) 5 to 80 parts by weight of a fatty acid having a molecular weight of at least 280 or a derivative thereof, and (c) 0.1 to 10 parts by weight of a basic inorganic metal compound capable of neutralizing acid groups on components (a), (d) and (b).

* * * * *